US007882711B2

(12) United States Patent
Bianchi

(10) Patent No.: US 7,882,711 B2
(45) Date of Patent: Feb. 8, 2011

(54) DEVICE FOR CLOSING THE TOE AT THE END OF TUBULAR HOSIERY ARTICLES

(76) Inventor: Massimo Bianchi, Via Morelli, 29-50018, Scandicci, Firenze (IT)

( * ) Notice: Subject to any disclaimer, the term of this patent is extended or adjusted under 35 U.S.C. 154(b) by 0 days.

(21) Appl. No.: 12/487,857

(22) Filed: Jun. 19, 2009

(65) Prior Publication Data

US 2010/0319410 A1 Dec. 23, 2010

(51) Int. Cl.
*D04B 9/40* (2006.01)

(52) U.S. Cl. ..... 66/148

(58) Field of Classification Search ..... 66/147, 66/148, 149 R
See application file for complete search history.

(56) References Cited

U.S. PATENT DOCUMENTS 1,188,125 A * 6/1916 Williams ..... 66/148
5,570,591 A * 11/1996 Frullini et al. ..... 66/58
5,727,400 A * 3/1998 Lonati et al. ..... 66/148
5,907,960 A * 6/1999 Lonati et al. ..... 66/28
6,164,091 A * 12/2000 Frullini et al. ..... 66/148
6,176,106 B1 * 1/2001 Lonati et al. ..... 66/95
6,223,564 B1 * 5/2001 Lonati et al. ..... 66/8

FOREIGN PATENT DOCUMENTS

EP 2080827 A1 * 7/2009
IT FI2006A000025 1/2006

* cited by examiner

*Primary Examiner*—Danny Worrell
(74) *Attorney, Agent, or Firm*—McGlew and Tuttle, P.C.

(57) ABSTRACT

To transfer the stitches from a first needle arc (7X) to a second opposed needle arc (7Y), a overturnable semicircular sector (19) presents elements (25) terminating in a bifurcate way (25F) (flanking inside the respective sinkers (11) the relevant needle (7X) of the first arc), each of which has an upper fork projection (25A) embracing the needle (7X) and forming a rear recess (25X) and a front recess (25C) suitable to engage an end stitch (M1) formed by the corresponding needle (7X), said stitch (M1) then being transferred and engaged on a corresponding needle (7Y) of the second needle arc.

20 Claims, 9 Drawing Sheets

VII
9A
9
11
11A
25
19
IV
24
15
23
17
13A
13
V
21
1Y
27
7X
5A
5
1
VI
31
21A
7Y
3
21

19
25
11A
11
25F
7x
9
31
13
21
5

19
25
25B
11A
11
f11
7x
31
13
21
5
9

19
25
11A
11
7x
9
31
13
21
5

DEVICE FOR CLOSING THE TOE AT THE END OF TUBULAR HOSIERY ARTICLES

FIELD OF THE INVENTION

The invention relates to a device, which is combined with a circular knitting machine, for producing the closure of tubular hosiery articles produced by this machine.

BACKGROUND OF THE INVENTION

Attempted solutions to this problem have not proved satisfactory. Solutions in which the articles are transferred from the production machine to a separate device have proved somewhat unsatisfactory and/or too costly and/or too bulky, especially if combined with each single machine.

SUMMARY OF THE INVENTION

The invention solves these problems, and also achieves other objects and advantages, which are apparent from the text below.

The device in question—for closing the end of hosiery articles on the same circular machine on which they are produced—is of the type of those that adopt a sector—generally semicircular—to transfer the stitches from a first needle arc to a second opposed needle arc, as defined in the Italian patent application no. FI2006A000025 of 21 Jan. 2006, the contents of which are incorporated herein by reference.

According to the invention, elements terminating in a bifurcate way are provided in said sector, each of which flanks—inside respective sinkers—the relevant needle of the first arc; each of said shaped elements terminating in a bifurcate way superiorly presents a fork projection embracing the needle and forming a rear recess and two front recesses, suitable to engage an end stitch formed by said needles.

There are also provided:

means to raise and lower the needles of the first arc to unload said end stitch, which thus remains engaged on said fork projection;

means to rotate said sector through approximately 180° and to take the end stitches engaged on said recesses to correspond with the needles of the second arc; and means to raise said needles of the second arc to a retained level so that each of them maintains the stitch formed thereby and to engage also the corresponding stitch engaged on said recesses and to thus form ranks of double closing stitches with the needles of the second arc.

Advantageously said fork projection presents the upper surface inclined.

A profile can also be provided, suitable to ensure raising of the latch of the needle, during initial lowering of the needle to release the stitches that are to be transferred from the first needle arc to the second needle arc, regardless of the presence of the released stitch.

A means may be provided for maintaining the shaped elements in an excluded lowered arrangement until the time of end closing of the article and for lifting the shaped elements such that the shaped elements engage the stitches on the fork shaped projections.

A unit may be provided on which the sector is articulated. The assembly may be capable of rotating with the needle cylinder and to be raised and lowered axially with respect to the cylinder to reach a lowered idle position and a raised active position and to engage the stitches of the needles of the first arc and to transfer the stitches to the needles of the second arc such that the needles of the second arc engage an end stitch thereof.

A tubular member may be provided for following raising and rotation of the needle cylinder. The tubular member may be partially rotated with respect to the needle cylinder for controlling overturning of the sector.

The means for moving the sinkers may raise and lower the sinkers. The means for moving the sinkers and the means for raising the needles may be controlled to form tight end stitches and at least one final loose stitch in the first needle arc, and to form with the needles of the second needle arc close stitches tightened on both edges that are in a closing step and at least one final loose stitch.

The invention also relates to a process for closing the end of hosiery articles on the same circular machine that produced them, with a sector—mostly semicircular—for transfer of the stitches from a first needle arc to a second opposed needle arc.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
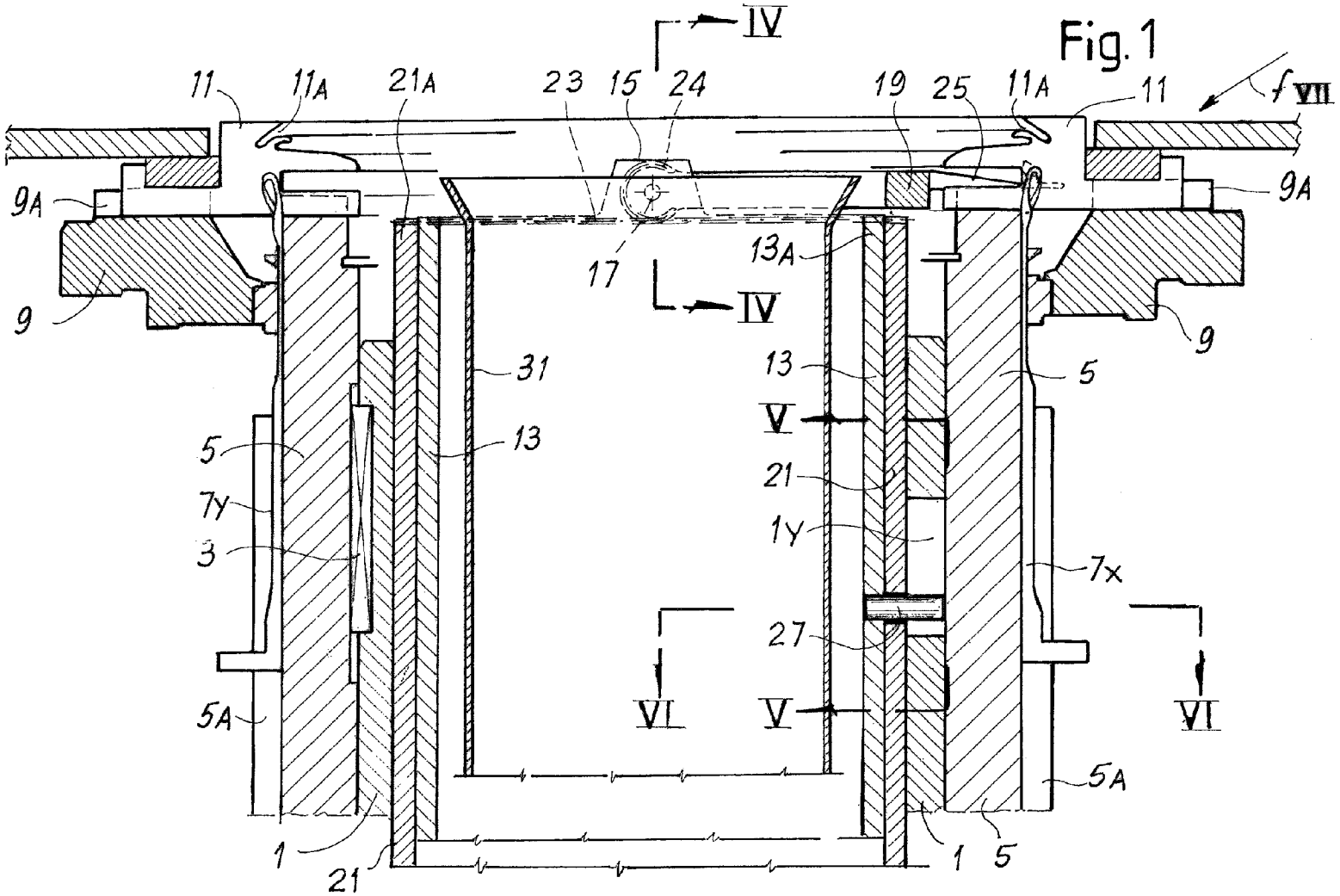
FIGS. 1 to 3 are axial sectional views of the upper part of the needle cylinder with accessories and with the device of the invention, in three subsequent arrangements.

Referring to the drawings, the reference 1 indicates a motor cylinder which rotates to draw in rotation—by means of tabs 3 or equivalent members—the needle cylinder 5, in the external longitudinal channels 5A of which the needles 7X and 7Y slide. The conventional collar 9 with radial channels 9A for sliding of the sinkers 11 is combined superiorly with the needle cylinder 5. Arrangement is customary.

The reference 13 indicates a cylinder which is coaxial and which rotates with the motor cylinder 1 and with the needle cylinder 5; two diametrically opposed supports 15 are provided on the upper edge 13A thereof, on which a semicircular sector 19 is pivoted with diametrical pins 17; said sector 19 is capable of overturning through approximately 180° to be arranged alternately corresponding to a first approximately semicircular needle arc 7X and at a second and opposed needle arc 7Y. To control overturning of the sector 19 alternately, a cylinder 21 is provided around the cylinder 13; the upper edge 21A of the cylinder 21 presents at least one toothing 23 which meshes with a toothing 24 of the sector 19 and coaxial to the pins 17. The cylinder 21 can rotate with the cylinders 13 and 5 through the action of the motor cylinder 1, as a constraining pin 27 is provided. The cylinder 21 can be angularly displaced by a few degrees with respect to the cylinder 13, to control overturning of the sector 19 through the toothings 23 and 24.

Figure 5:
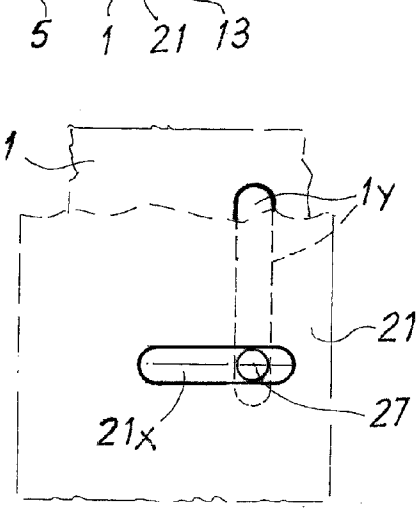
Figure 6:
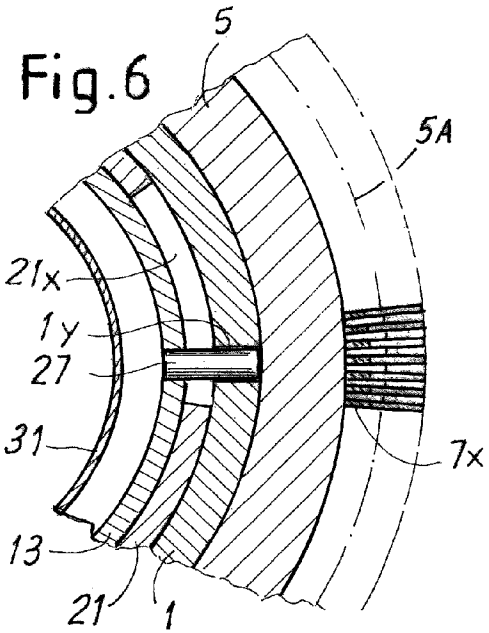

The two cylinders 13 and 21 and the sector 19 can be raised and lowered together axially with respect to the needle cylinder, for purposes that will be explained below; this is permitted by a vertical slot 1Y of the cylinder 1, through which the pin 27 that draws the two cylinders 13 and 21 in rotation passes. Also the needle cylinder 5 with the sinkers 11 can be axially displaced, to obtain prompt dimensional variations of the stitches of the tubular knitted fabric of the article. The cylinder 21 presents a limited slot 21X (FIG. 5), so that it can be made to rotate with respect to the other cylinders 13 and 1.

A customary tubular guide 31 is provided inside the cylinder 13, to implement pneumatic tensioning of the article being formed, with a suction current.

Each sinker 11 presents the customary shaped slot 11A, to cooperate with the hook of the needle 7X and 7Y, for customary knitting of the tubular article of the sock or other equivalent article.

At the end of forming of the tubular fabric, the toe of the article can be closed, if necessary after forming a pocket with the needles of the first arc, with continuous motion or with alternating motion of the needle cylinder. The sector 19 must then be overturned with the end edge formed by the first needle arc 7X, until the last stitches formed by the needle arc 7X are combined with the last stitches formed by the second needle arc 7Y. This is implemented by the special structure of the sector 19, suitable to cooperate with the sinkers and with the needles.

Figure 2:
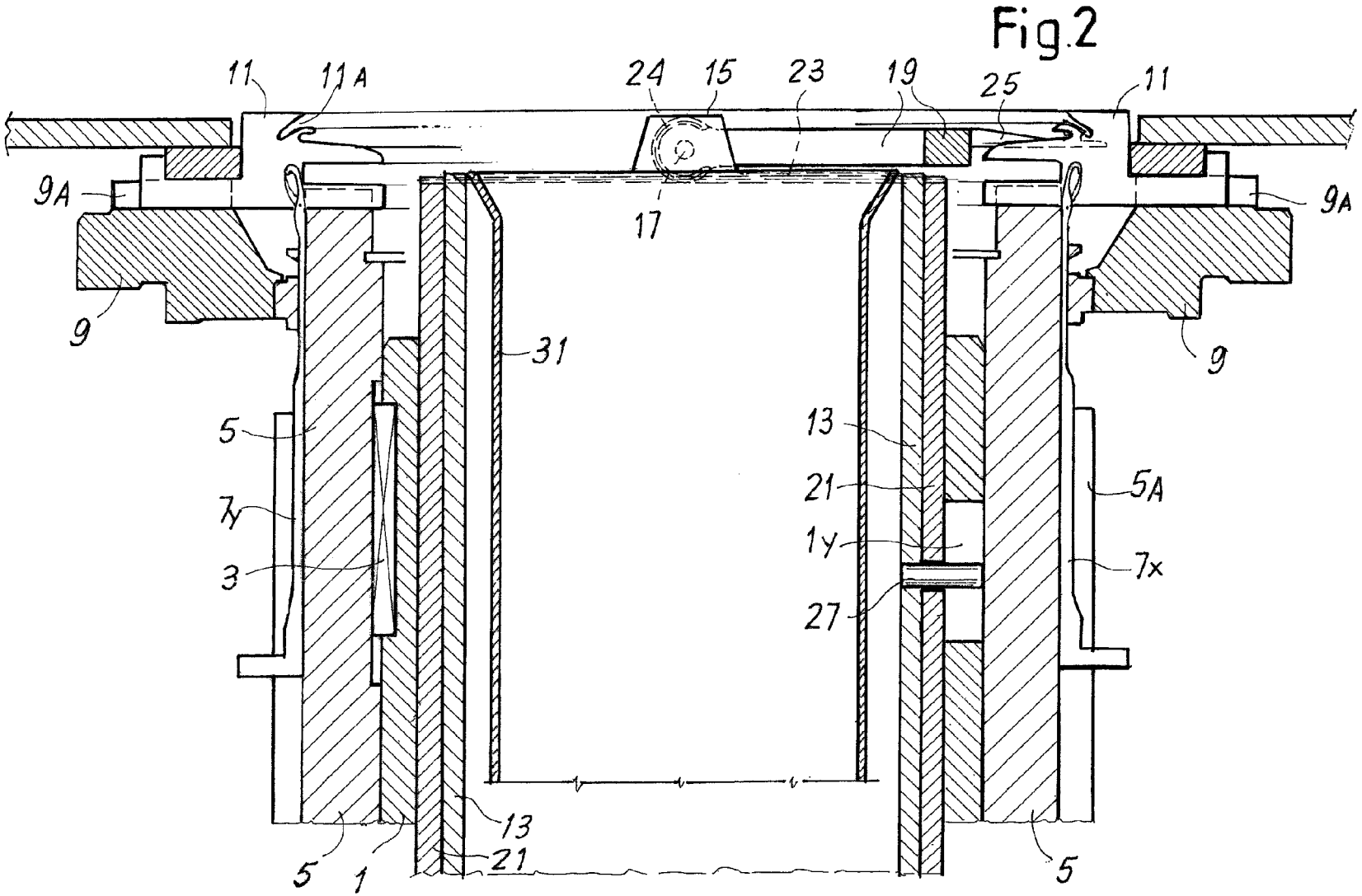
Figure 12:
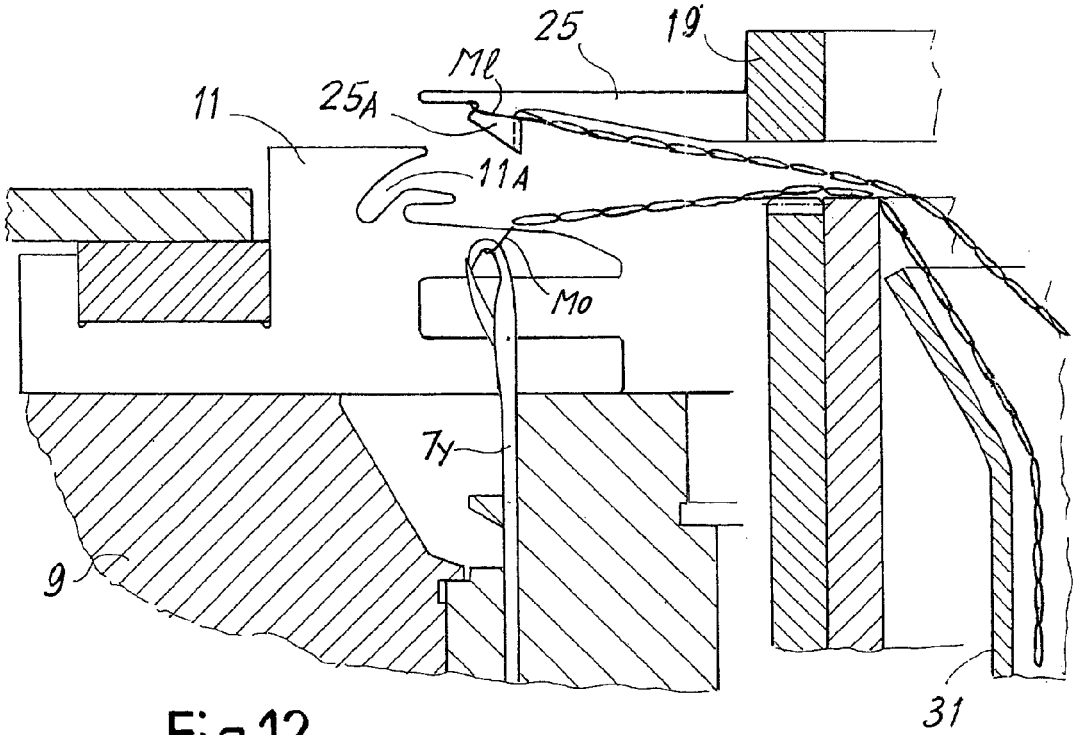

The sector 19—according to the invention—can be moved between a lowered and inactive position below the area in which the shaped slots 11A of the sinkers 11 are located, and a raised and active position (FIGS. 2, 8, 12) almost at the level of said shaped slots 11A. In the lowered position and in the arrangement of the sector 19 in correspondence of to the needles of the first needle arc (FIGS. 1, 2, 7), the circular machine can form the article in the conventional manner, with or without the end pocket for the toe to be closed.

Figure 8:
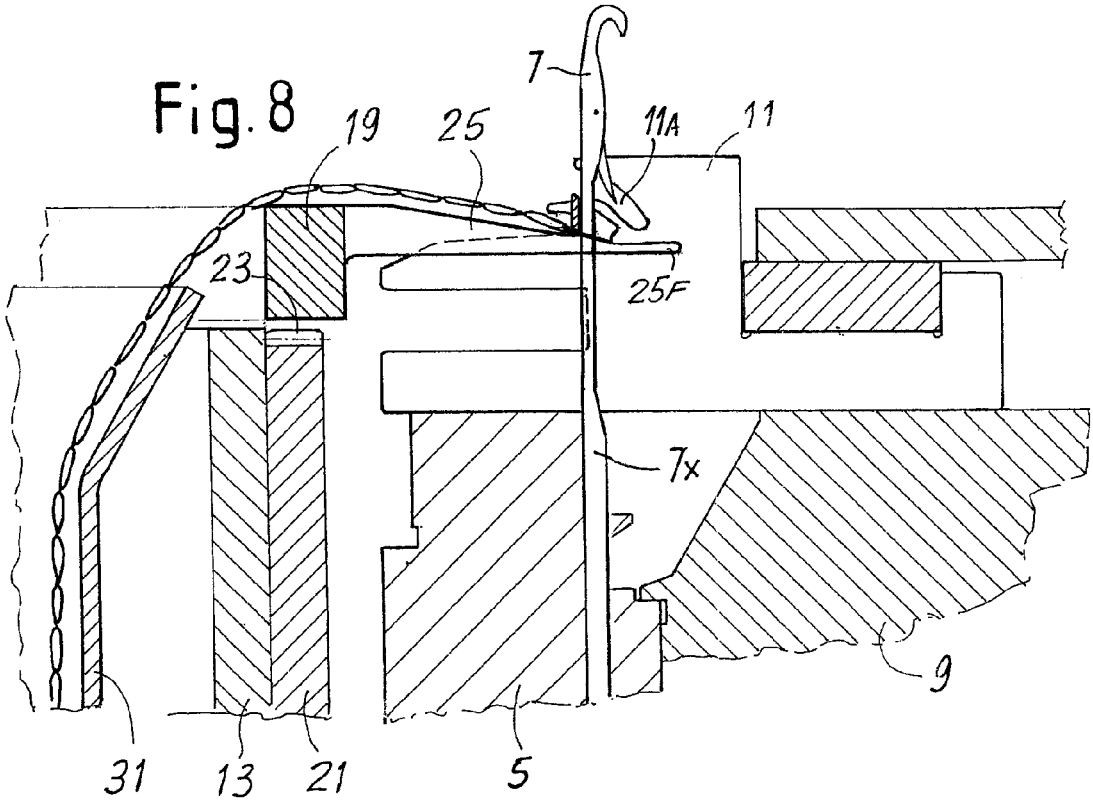
FIGS. 8 and 9 are local sectional views in arrangements subsequent to that of FIG. 7.
Figure 9:
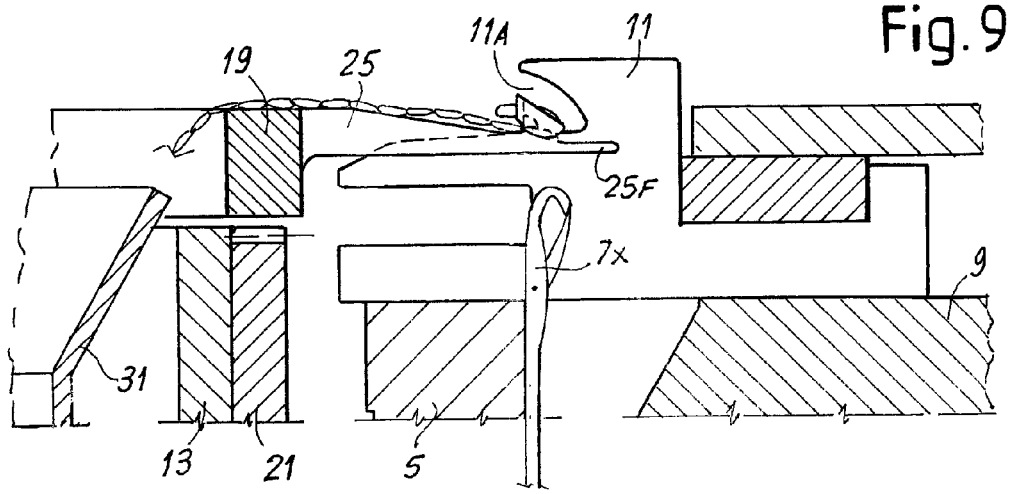
Figure 16:
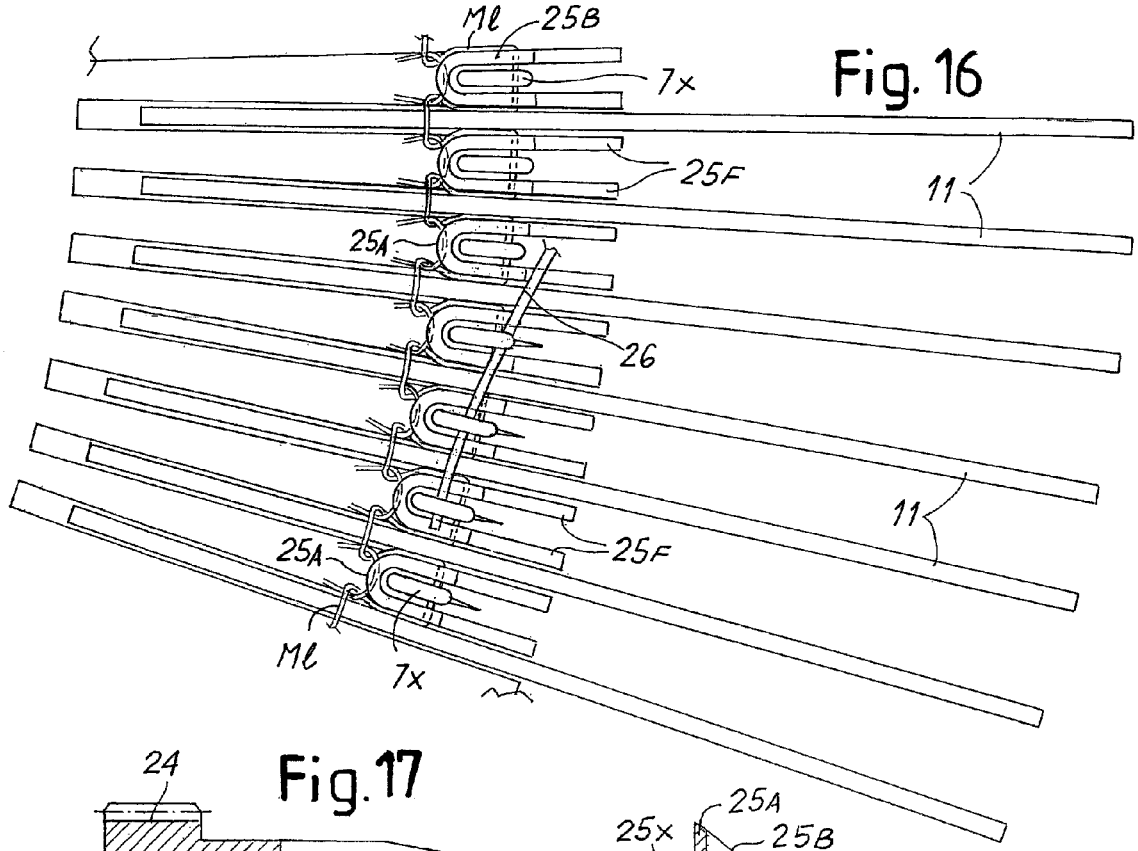
FIGS. 16 and 17 are plan views of a portion of the semicircular sector isolated, without stitches and with stitches.
Figure 17:
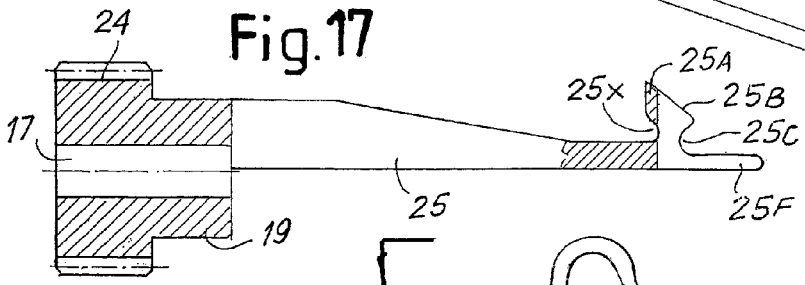
Figure 18:
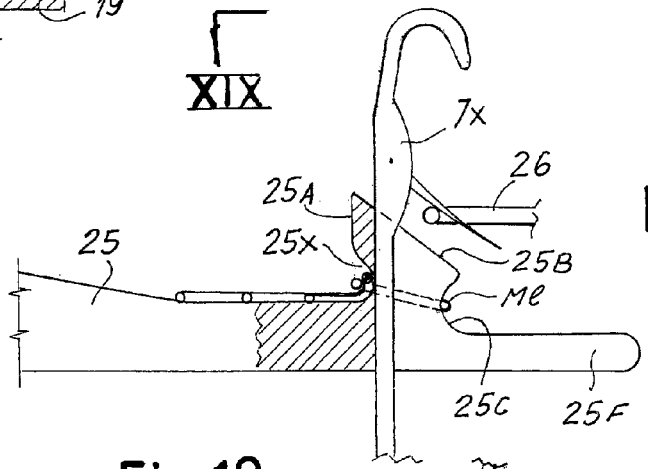
FIG. 18 is a local sectional view according to XVIII-XVIII of FIG. 16.
Figure 19:
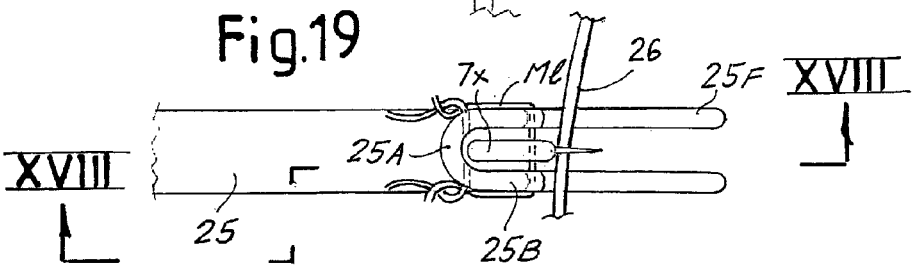
FIG. 19 is an enlarged detail view of FIG. 18, viewed from the line XIX-XIX of FIG. 18.

The sector 19, along the arcuate extension thereof, presents a plurality of radial appendages 25, each terminating with a pair of radially extending shaped elements 25F (see in particular FIG. 19); the two elements 25F of each pair extend approximately radially to flank one of the needles 7X of the first needle arc in the first arrangement (FIGS. 1 and 2) and also one of the needles 7Y of the second needle arc, in the second overturned arrangement (FIG. 3) of the sector 19; the two shaped elements 25F of each pair are located between the relevant needle 7X and the two sinkers 11 which flank the needle and which cooperate therewith. The two shaped elements 25F of each pair superiorly present—in the arrangement in correspondence of the first needle arc 7X—a U-shaped projection 25A which in the plan view extends in a radially oriented U-shape open toward the outside (see in particular FIGS. 16 to 18) with an upper edge 25B which—when the sector 19 is in the raised arrangement of FIGS. 2, 8, 9—approximately follows the profile of the shaped slot 11A of the relevant sinker; said edge 25B extends outward (with respect to the axis of the cylinders) with two edges 25C sunken toward the end of the element 25, 25F following approximately laterally the bottom of the slot 11A of the sinkers but projecting slightly with respect to said slot 11A.

Figure 7:
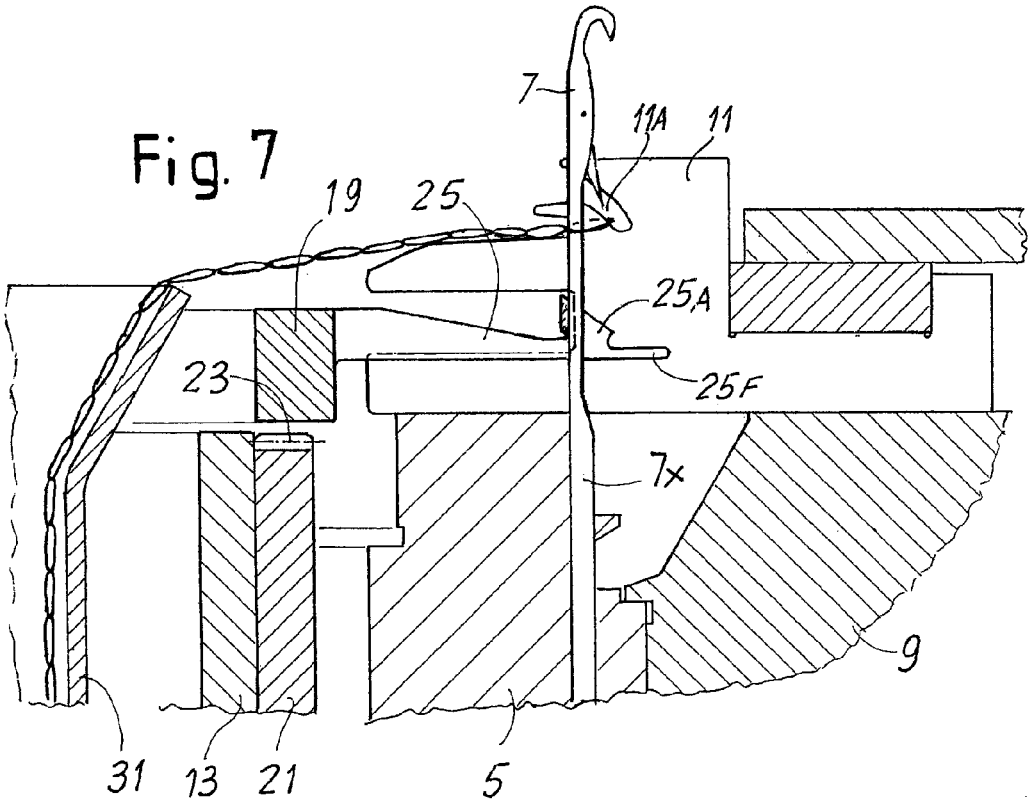
FIG. 7 is a sectional view of the area indicated by the arrow $f_{VII}$ of FIG. 1, in a step prior to transfer.
Figure 10:
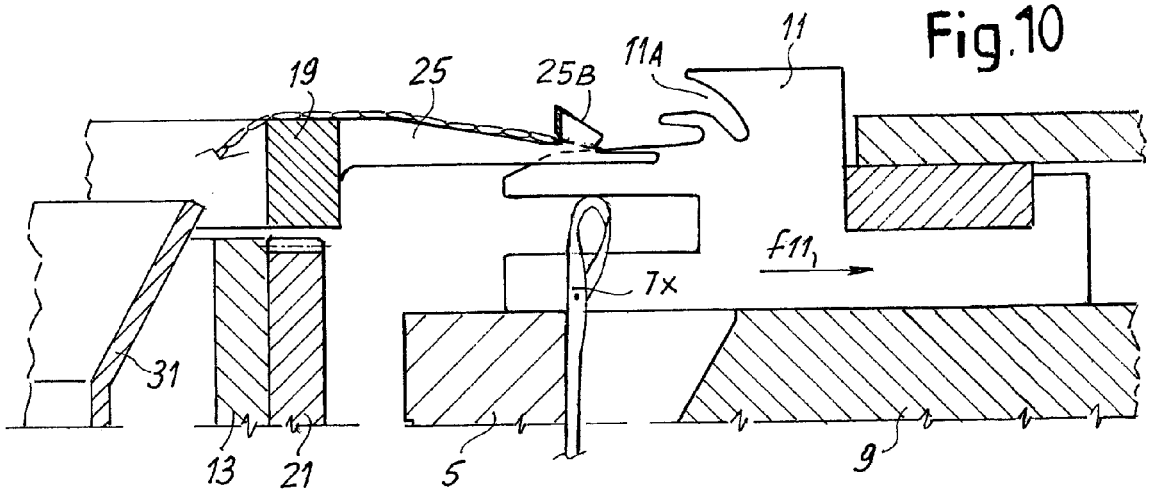
FIGS. 10, 11 and 12 are sectional views that show, analogously to FIG. 7, two of the arrangements prior to transfer.
Figure 11:
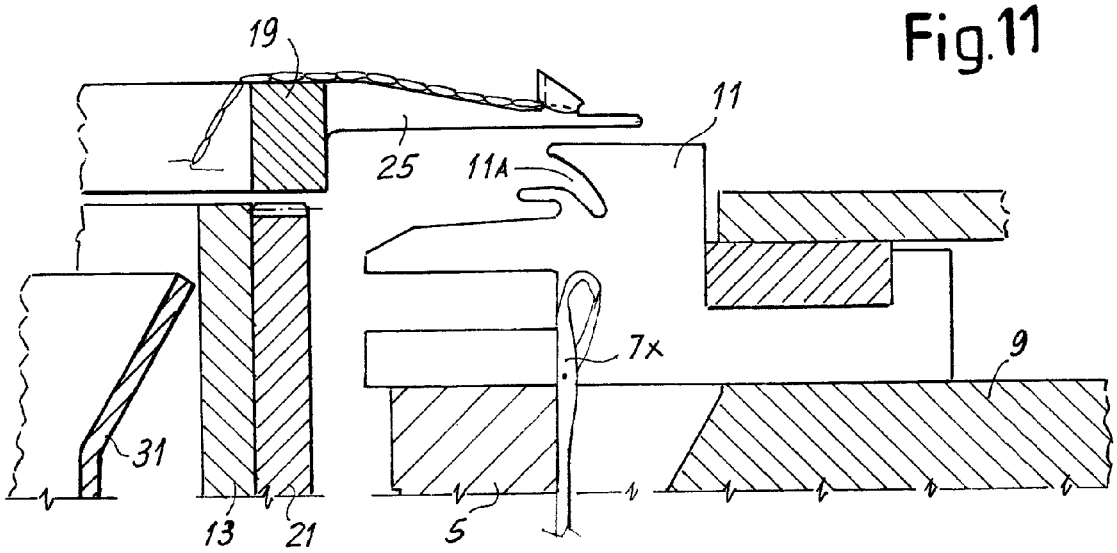

In the placement described, with the element 25, 25F from the arrangement of FIGS. 7 and 10 with the needles 7X maintained lowered without taking up thread, the sinkers 11 are moved away according to f19 (FIG. 11). In this manner, the last stitch Ml remains engaged on the element 25, 25A, so that the fabric ending with the rank of stitches Ml can be easily transferred to the needles 7Y of the second needle arc, with overturning of the sector 19 about the pins 17.

The needles 7Y of the second arc are maintained idle and lowered, with the last stitch Mo engaged thereon. The needles 7X of the first needle arc are lowered without taking up thread, so that the last formed stitches Ml remain engaged as specified above between the recesses 25C and 25X; these stitches Ml are stressed by pneumatic tensioning through suction from the tube 31. To ensure that the latch of the needles 7X is lowered on the end thereof, said element 26 is provided, which promptly ensures raising of the latch of the needles 7X that start to be lowered; therefore the needles 7X safely release the stitch Ml, which remains retained between the recesses 25X and 25C.

At this point—to actuate transfer of the stitches Ml to the needles 7Y—the cylinder 13 and therefore the sector 19 are raised and through the toothings 23, 24 the sector 19 is overturned through 180° about the pins 17 drawing the stitches Ml, which remain pneumatically tensioned and thus in an elongated and also enlarged arrangement, being engaged on the respective projections 25A extending with a radially oriented U-shape.

Figure 3:
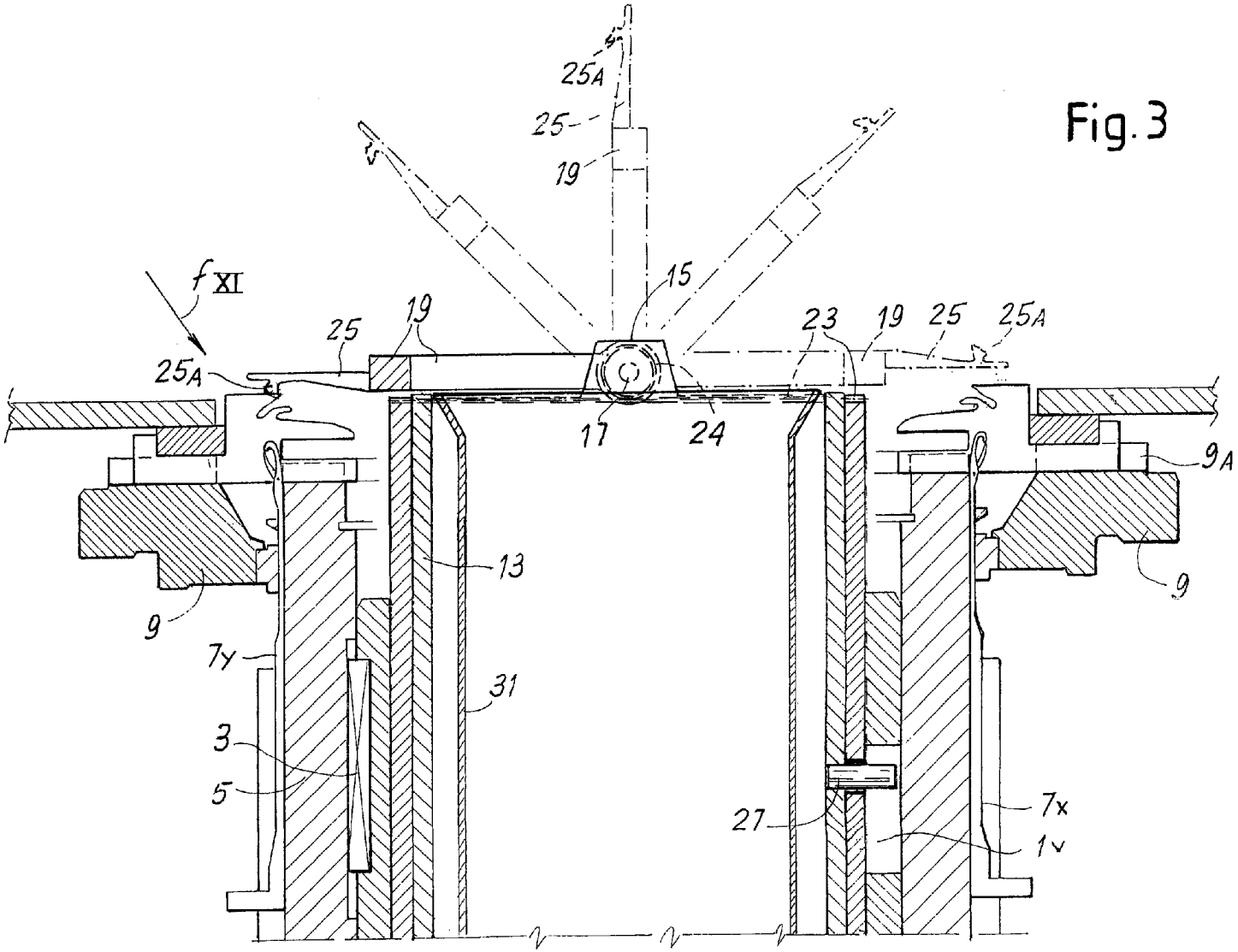
Figure 4:
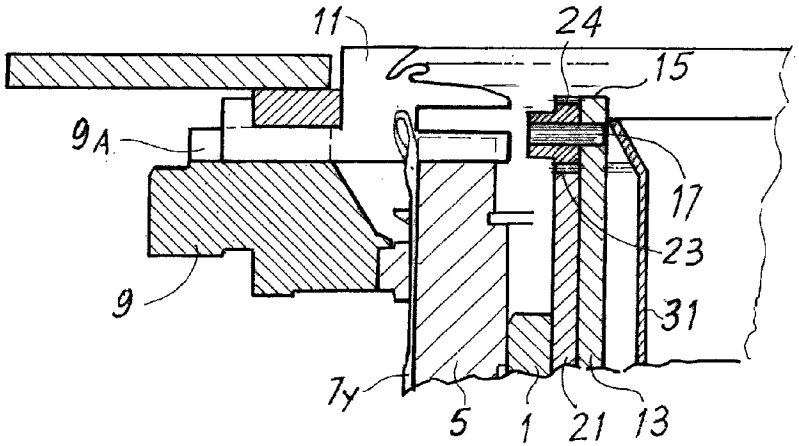
FIGS. 4, 5 and 6 are local sectional views according to IV-IV, V-V and VI-VI of FIG. 1.
Figure 13:
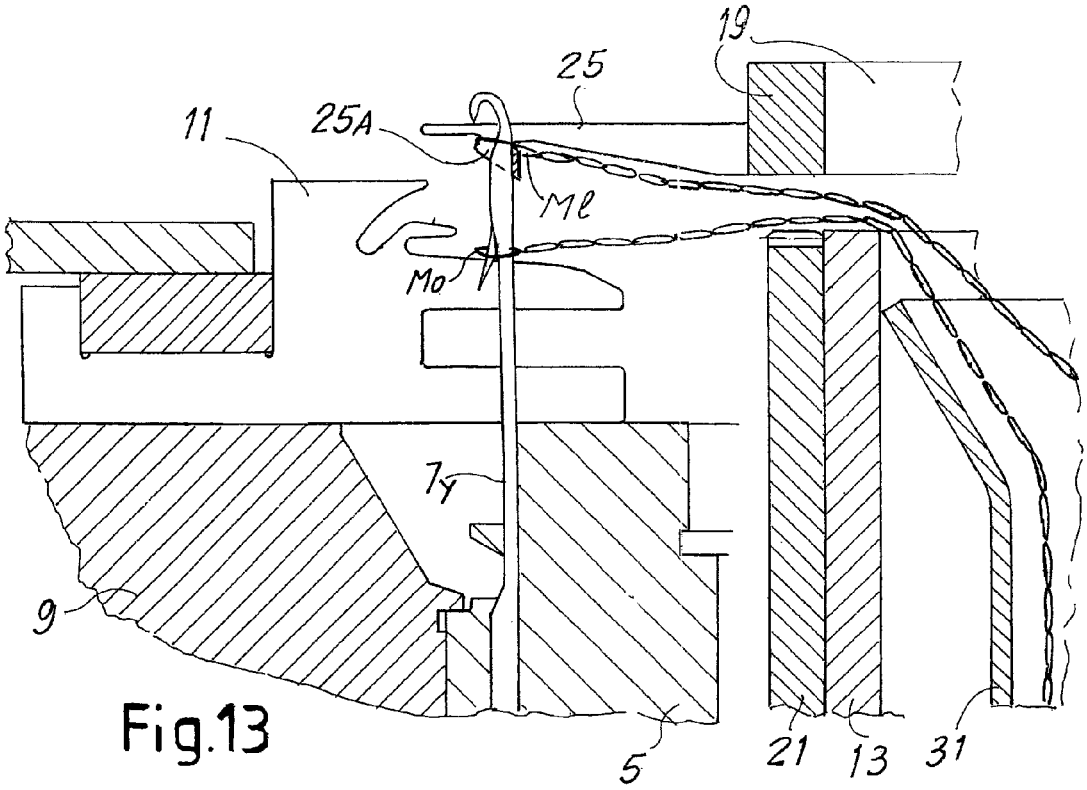
FIGS. 13, 14 and 15 are sectional views showing the area indicated by the arrow $f_{XI}$, of FIG. 3, in subsequent operating steps implemented after transfer.
Figure 14:
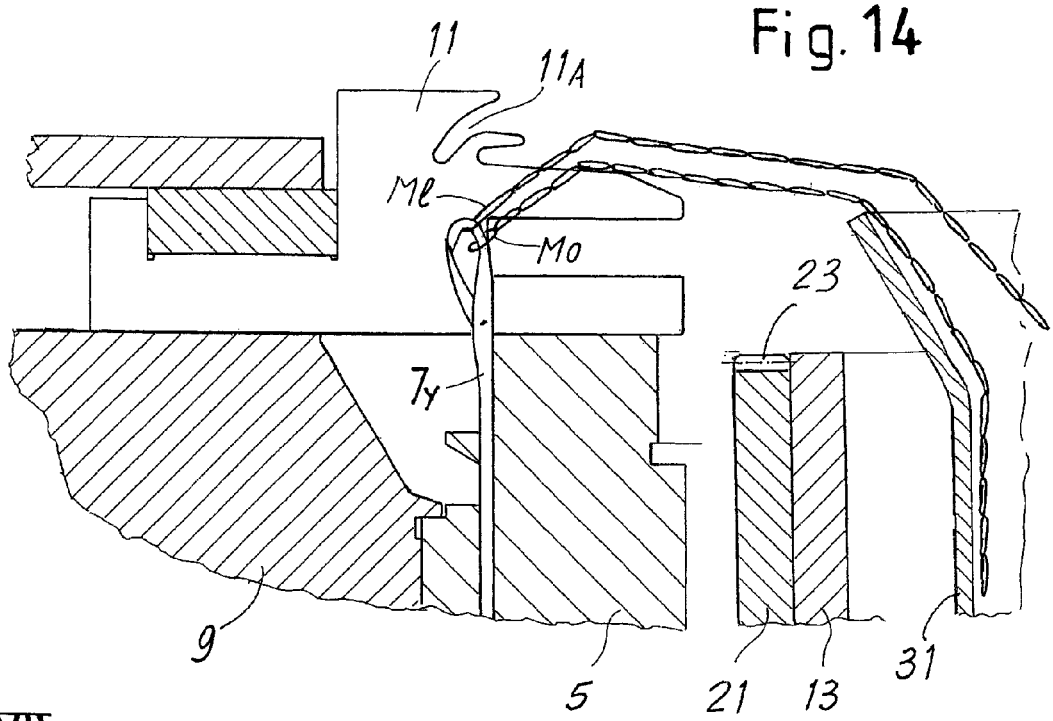
Figure 15:
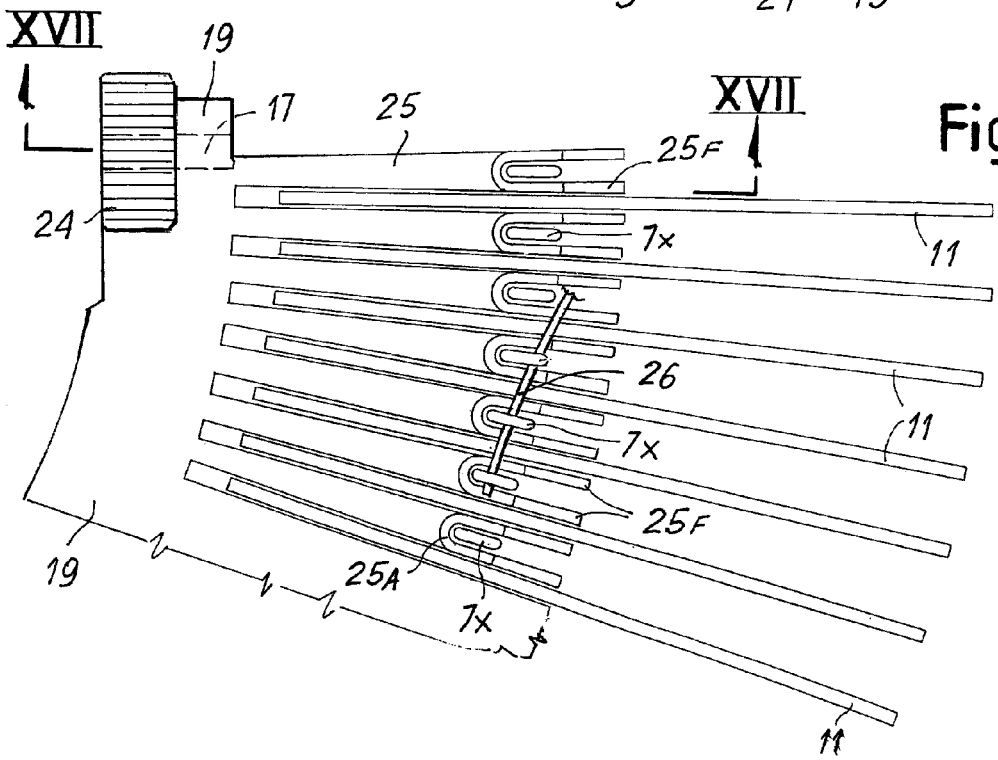

After overturning of the sector 19 (as indicated by the broken lines in FIG. 3) until reaching the position indicated in FIGS. 3, 13, 14, the shaped elements 25A are positioned so as to embrace the relevant needles 7Y of the second needle arc. At this point, the needles 7Y of the second needle arc are raised inside the space of the respective projections 25A to a limited level (retained level) in which said needles 7Y maintain the stitch Mo of the last rank of stitches produced thereby but they come (FIG. 14) so that they are able also to engage—together with the stitch Mo—the relevant stitch Ml, which is enlarged by the respective projection 25A and by the pneumatic tensioning applied by the tube 31; in this manner the stitches Mo and Ml are both engaged by the relevant needles 7Y of the second arc. At this point said needles 7Y of the second arc—with alternating motion or with continuous motion, and with final cut of the thread, form further ranks of stitches, in particular tight stitches and a final loose stitch or another solution, to in any case prevent unraveling of the finishing ranks of the article, for example closure of the final end of the article. The article—when finished—is released.

With inverse movements, all parts are returned to the initial conditions.

While specific embodiments of the invention have been shown and described in detail to illustrate the application of the principles of the invention, it will be understood that the invention may be embodied otherwise without departing from such principles.

What is claimed is:

1. A device for closing the end of tubular hosiery articles on a circular machine that produces the articles, the device comprising:

a needle cylinder;

a plurality of needles forming a first needle arc arranged in said needle cylinder;

another plurality of needles forming a second needle arc arranged in said needle cylinder opposite said first needle arc;

a plurality of sinkers cooperating with said plurality of needles to form stitches;

a substantially semicircular sector to transfer stitches from said first needle arc to said second opposed needle arc;

a plurality of radially projecting appendages arranged in said sector, each of said radially projecting appendages terminating in a bifurcated manner with two shaped elements, each of said two shaped elements being movable into an engagement position where said two shaped elements are flanking a relevant needle of the first needle arc within a respective one of said plurality of sinkers, each of said radially projecting appendages comprising a U-shaped fork projection oriented approximately radially with respect to said semicircular sector and being radially outwardly open, said U-shaped fork projection partly embracing a respective said one of said needles when said shaped elements of said radially projecting appendages are arranged between a respective said needle and a respective one of said sinkers, each of said U-shaped fork projections forming a rear recess extending transversely to said two shaped elements, and two front recesses for engaging an end stitch formed by needles of the first needle arc;

a means for raising and lowering the needles of the first arc to unload said end stitch, said end stitch being engaged on said fork projection;

a means for rotating said sector through approximately 180° about a diametrical geometrical axis of the cylinder and for taking the end stitches engaged on said recesses in correspondence of the needles of the second arc;

a means for raising said needles of the second arc to a retained level to maintain the stitch formed by each of these needles and for engaging the corresponding stitch engaged on said recesses and for forming a rank of double closing stitches with the needles of the second arc; and a means for moving the sinkers radially away, in the operation of forming said end stitches.

2. A device as claimed in claim 1, wherein said U-shaped fork projection comprises an inclined upper surface.

3. A device as claimed in claim 1, further comprising a profile suitable to ensure raising of a latch of the needles of the first needle arc during initial lowering of each needle of the first needle arc, in the operation prior to transfer of the stitches to the needles of the second needle arc.

4. A device as claimed in claim 1, further comprising a means for maintaining said shaped elements in an excluded lowered arrangement until a time of an end closing of the article and for lifting said shaped elements such that said shaped elements engage the stitches on said U-shaped fork projections.

5. A device as claimed in claim 4, further comprising a unit on which said sector is articulated, said unit being capable of rotating with the needle cylinder and to be raised and lowered axially with respect to said needle cylinder to reach a lowered idle position and a raised active position and to engage the stitches of the needles of the first needle arc and to transfer said stitches to the needles of the second needle arc such that said needles of the second needle arc engage an end stitch thereof.

6. A device as claimed in claim 1, further comprising a tubular member following raising and rotation of the needle cylinder, said tubular member being partially rotated with respect to the needle cylinder for controlling overturning of said sector.

7. A device as claimed in claim 1, wherein said means for moving the sinkers raises and lowers the sinkers, said means for moving said sinkers and said means for raising said needles are controlled to form tight end stitches and at least one final loose stitch in the first needle arc, and to form with the needles of the second needle arc close stitches tightened on both edges that are in a closing step and at least one final loose stitch.

8. A process for closing the end of hosiery articles on a circular machine that produces the hosiery articles, by means of transfer of stitches formed by a first needle arc to the needles of a complementary opposed second needle arc, the process comprising:

providing a plurality of U-shaped fork projections, each of said plurality of U-shaped fork projections having a base and two leg portions, said two leg portions having ends diametrically opposite said base, each said base defining a stitch engaging recess, each said ends of said two leg portions each defining a stitch engaging recess;

engaging an end stitch of each of the needles of a first needle arc on a respective said U-shaped fork projection, each said base of said U-shaped fork projections radially rearwardly flanking one of said needles of the first needle arc;

raising the needles of the first arc to unload the end stitches, said needles of said first arc engaging said end stitches onto said stitch engaging recesses of each of said U-shaped fork projections;

providing a sector on which said U-shaped fork projections are mounted;

rotating said sector through approximately 180° such that the stitches engaged on said U-shaped fork projections correspond with needles of the second arc; and raising said needles of the second arc to a retained level of a last stitch thereof such that said needles of said second arc engage corresponding stitches and disengage said stitches from said U-shaped fork projections to form ranks of double closing stitches.

9. A process as claimed in claim 8, wherein said U-shaped fork projections are maintained in an excluded arrangement until the steps for end closing of the article.

10. A process as claimed in claim 8, wherein tight end stitches and at least one final loose stitch are formed for release by the needles of the first needle arc, and tight stitches are formed on two edges connected in the closing step and at least one final loose stitch by the needles of the second needle arc.

11. A device as claimed in claim 2, further comprising a profile suitable to ensure raising of a latch of the needles of the first needle arc during initial lowering of each needle of the first needle arc, in the operation prior to transfer of the stitches to the needles of the second needle arc.

12. A process as claimed in claim 9, wherein tight end stitches and at least one final loose stitch are formed for release by the needles of the first needle arc, and tight stitches are formed on two edges connected in the closing step and at least one final loose stitch by the needles of the second needle arc.

13. A device for closing an end of a tubular hosiery article on a circular needle machine that produces the tubular hosiery article, the device comprising:

a needle cylinder;

a plurality of needles forming a first needle arc arranged in said needle cylinder;

another plurality of needles forming a second needle arc arranged in said needle cylinder, said second needle arc being arranged opposite said first needle arc;

a substantially semicircular sector to transfer stitches from said first needle arc to said second needle arc, said sector being arranged on one end of said needle cylinder;

a plurality of radially projecting appendages arranged in said sector, each of said radially extending appendages having an end with two shaped elements which form a bifurcation, said each of radially projecting appendages being movable into and out of an engagement position where a respective said two shaped elements of one of said appendages flank a different one of said needles of said first needle arc;

a U-shaped fork projection arranged on each of said radially projecting appendages, each said projection extending from respective said two shaped elements in a direction transverse to a bifurcation plane of said respective two shaped elements, said each U-shaped fork projection wrapping around from one of said respective shaped elements along a base of said bifurcation to the other of said respective shaped elements, said each U-shaped fork projection defining a radially inward recess and two radially outward recesses shaped for engaging an end stitch formed by said needles of the first needle arc when said plurality of radially projecting appendages are moved into and out of said engagement position;

a first needle moving device raising and lowering said needles of said first needle arc to transfer the end stitch from said needles of said first needle arc to respective said U-shaped fork projections;

a sector moving device rotating said sector about a diametrical axis of said needle cylinder and taking the end stitches from said needles of said first needle arc and engaged on said recesses of said appendages, into correspondence with said needles of said second needle arc;

a second needle moving device raising said needles of said second needle arc to a level to maintain a stitch formed by each of said needles of said second needle arc and for engaging the corresponding end stitch engaged on said recesses of said appendages, and for forming a rank of double closing stitches with said needles of said second needle arc.

14. A device in accordance with claim 13, further comprising:

a plurality of sinkers cooperating with said plurality of needles to form stitches, each of said plurality of appendages flanking a respective said needle inside a respective said sinker when said respective appendage is in said engagement position a sinker moving device moving said plurality of sinkers radially away, in an operation of forming the end stitches.

15. A device in accordance with claim 13, wherein:

said U-shaped fork projections have a base end arranged radially inward, and have an open end arranged radially outward.

16. A device in accordance with claim 13, wherein:

each of said plurality of U-shaped fork projections have a base and two leg portions, said two leg portions having ends diametrically opposite said base, each of said bases being arranged adjacent a radially inward side of a respective said needle in said engagement position, said each base defining a stitch engaging recess, each of said ends of said two leg portions each defining a stitch engaging recess.

17. A device as claimed in claim 13, wherein:

each of said U-shaped fork projections comprises an inclined surface diametrically opposite a respective said two shaped elements.

18. A device as claimed in claim 13, further comprising:

a profile suitable to ensure raising of a latch of said needles of said first needle arc during an initial lowering of each of said needles of said first needle arc, in an operation prior to transfer of the stitches to said needles of said second needle arc;

means for maintaining said shaped elements in an excluded lowered arrangement until a time of end closing of the article and for lifting said shaped elements such that said shaped elements engage the stitches on said U-shaped fork shaped projections.

19. A device as claimed in claim 18, further comprising:

a unit on which said sector is articulated, said unit being capable of rotating with said needle cylinder and to be raised and lowered axially with respect to said needle cylinder to reach a lowered idle position and a raised active position and to engage the stitches of said needles of said first needle arc and to transfer the stitches to said needles of said second needle arc such that said needles of said second arc engage an end stitch thereof.

20. A device as claimed in claim 14, wherein:

a tubular member is included for following a raising and rotation of said needle cylinder, said tubular member being partially rotated with respect to said needle cylinder for controlling an overturning of said sector;

said sinker moving device also raises and lowers said sinkers, said sinker moving device and said first and second needle moving devices are controlled to form tight end stitches and at least one final loose stitch in said first needle arc, and to form with said needles of said second needle arc close stitches tightened on both edges that are in a closing step and at least one final loose stitch.

* * * * *